United States Patent [19]

Chang

[11] Patent Number: 4,763,389

[45] Date of Patent: Aug. 16, 1988

[54] CLIPBOARD STRUCTURE

[76] Inventor: Shih-Ho Chang, No. 2-12, Chang Lu Road, Chang Hwa City, Taiwan

[21] Appl. No.: 108,387

[22] Filed: Oct. 14, 1987

[51] Int. Cl.[4] ..... B42F 1/00

[52] U.S. Cl. ..... 24/67.11; 24/67 R; 24/67.7

[58] Field of Search ..... 24/67.11, 67.7, 67 R, 24/67.3, 67.5, 67.9

[56] References Cited

U.S. PATENT DOCUMENTS

| | | | |
|---|---|---|---|
| 1,039,571 | 9/1912 | McPherson | 24/67.11 |
| 1,609,041 | 11/1926 | Pauker | 24/67 R |
| 2,862,328 | 12/1958 | Wadsworth | 24/67.7 |
| 3,105,279 | 10/1963 | Westhoff | 24/67.5 |
| 3,423,798 | 1/1969 | O'Donnell | 24/67.11 |
| 3,597,813 | 8/1971 | Takahash | 24/67.5 |
| 3,968,546 | 7/1976 | Seabor et al. | 24/67.11 |
| 4,628,572 | 12/1986 | Chang | 24/67.11 |

*Primary Examiner*—Victor N. Sakran
*Attorney, Agent, or Firm*—Spencer & Frank

[57] ABSTRACT

By modification of the design on the U-shaped bracket in previously awarded U.S. Pat. No. 4,628,572, the invention provided a renovated structure for a kind of hinge-typed clipboard which can also equally avoid to use rivets in assembly work. Its elements consist of a board, a supporting base, a clamping element, a torsional spring and a pivotal axle. The distinctive features are that the supporting base is made of metal plate with both sides bent upward and ends rolled up into tube shape. On the board, two transverse groove slots are provided to allow the tube-shaped element of supporting base penetrating through upward from the bottom of the board for combination with clamping element, spring and pivotal axle into an integral clipboard.

1 Claim, 4 Drawing Sheets

CLIPBOARD STRUCTURE

BACKGROUND OF THE INVENTION

The presented invention is related to the renovation of a kind of clipboard structure especially referring to an improved clip structure of clipboard to avoid usage of rivets in assembly work.

As clipboard are greatly diversified, FIG. 1 to FIG. 3 illustrate a kind of conventional clipboard comprising the major elements of a board (1), a supporting base (2), a clamping element (3), a pivotal axle (4) and a torsional spring (5). For assembly, a clamping member is made by combination of supporting base (2), clamping element (3), pivvotal axle (4) and torsional spring (5) and for riveting the clamping member on the board (1), rivets (6) are inserted through holes (201) (202).

Another kind of conventional clipboard being generally used as shown in FIG. 4 and FIG. 5 is mainly consisted of the elements of a board (7), a supporting base (8), a clamping element (9), a pivotal axle (10) and a torsional spring (11). At the rear side of supporting base (8) and clamping element (9), a curved roll-up portion exists. By virtue of pivotal axle (10) and spring (11), the supporting base (8) and clamping element (9) are pivotally connected into a similar hinge-typed clipboard. On the supporting base (8), two holes (801) (802) permit rivets (12) (13) inserting through to fix the supporting base (8) on the board (7). On the former conventional clipboard mentioned above, the applicant already presented improvement method and were awarded with U.S. Pat. No. 4,628,572. The presenting invention is aimed at the latter, the hinge-typed clipboard, for improvement. The assembly work of conventional clipboard as shown in FIG. 4 is very troublesome. As the supporting base (8) and clamping element (9) are installed in parallel, if the clamping member completed after combination of supporting base (8), clamping element (9), pivotal axle (10) and torsional springcouples with board (7), the clamping element (9) will cover up fixing holes (801) (802) on supporting base (8) causing inconvenience of riveting for rivets (12) (13) and if supporting base (8) and board (7) are riveted first and then combined with other elements, it will be very hard to install spring (11) and pivotal axle (10). In case of slight carelessness, the riveting of board (7) by means of rivets (12) (13) will break the board to be salvaged. In view of above-mentioned shortcomings, the applicant devoted himself to continuous study for improvement of such hinge-type clipboard in succession to the award of U.S. Pat. No. 4,628,572 so as to identically avoid using rivets, for coupling with board so that clipboard's manufacturing facility cost can be lowered and assembly safety upgrade.

SUMMARY OF THE INVENTION

The invention is to provide renovated structure for a kind of clipboard based on the U-shaped bracket in applicant's awarded U.S. Pat. No. 4,628,572 for design modification so that the hinge-typed clipboard can equally avoid using rivets in assembly work. It is consisted of a board, a supporting base, a clamping element, a torsional spring and a pivotal axle. It's distinctive features are that the supporting base is made of metal plat with both sides bent upward and ends rolled up into tube shape. On the board, the two transverse groove holes are provided to permit the tube-shaped element of supporting base penetrating through upwardly from the bottom of the board for combination with clamping element, spring and pivotal axle into an integral body.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENTS

Figure 1:
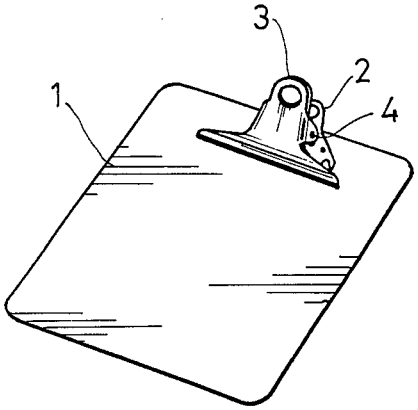
Fig. 1 PRIOR ART
FIG. 1 illustrates the perspective view of conventional clipboard.
Figure 2:
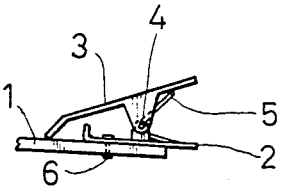
Fig. 2 PRIOR ART
FIG. 2 illustrates the partially elevational view of the clipboard shown in FIG. 1.
Figure 3:
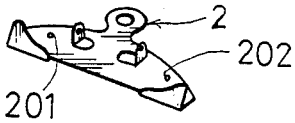
Fig. 3 PRIOR ART
FIG. 3 illustrates the perspective view to show the supporting base of clipboard in FIG. 1.
Figure 5:
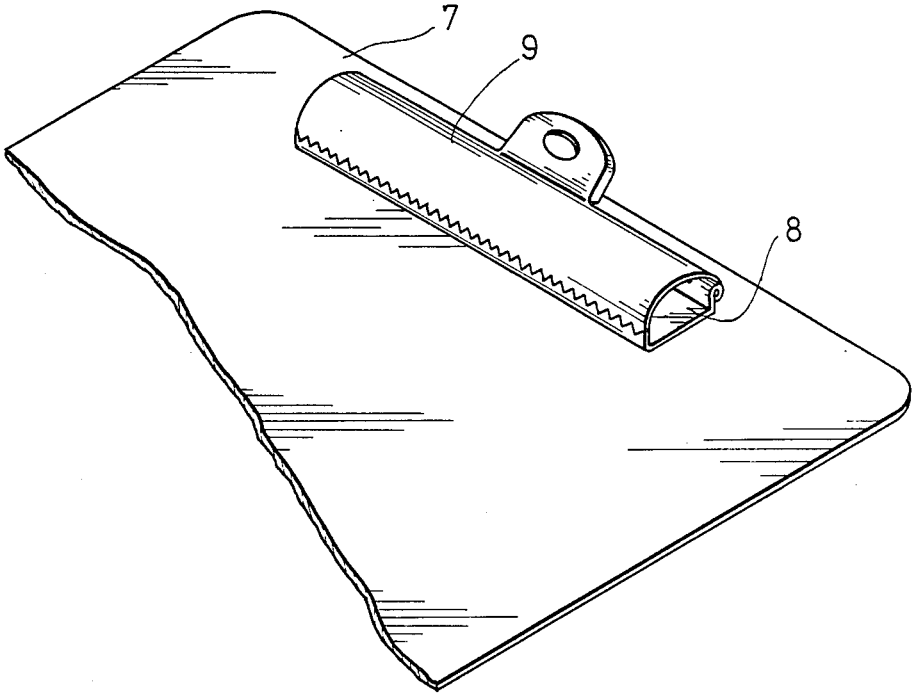
Fig. 5 PRIOR ART
FIG. 5 illustrates the perspective view of the clipboard shown in FIG. 4.
Figure 4:
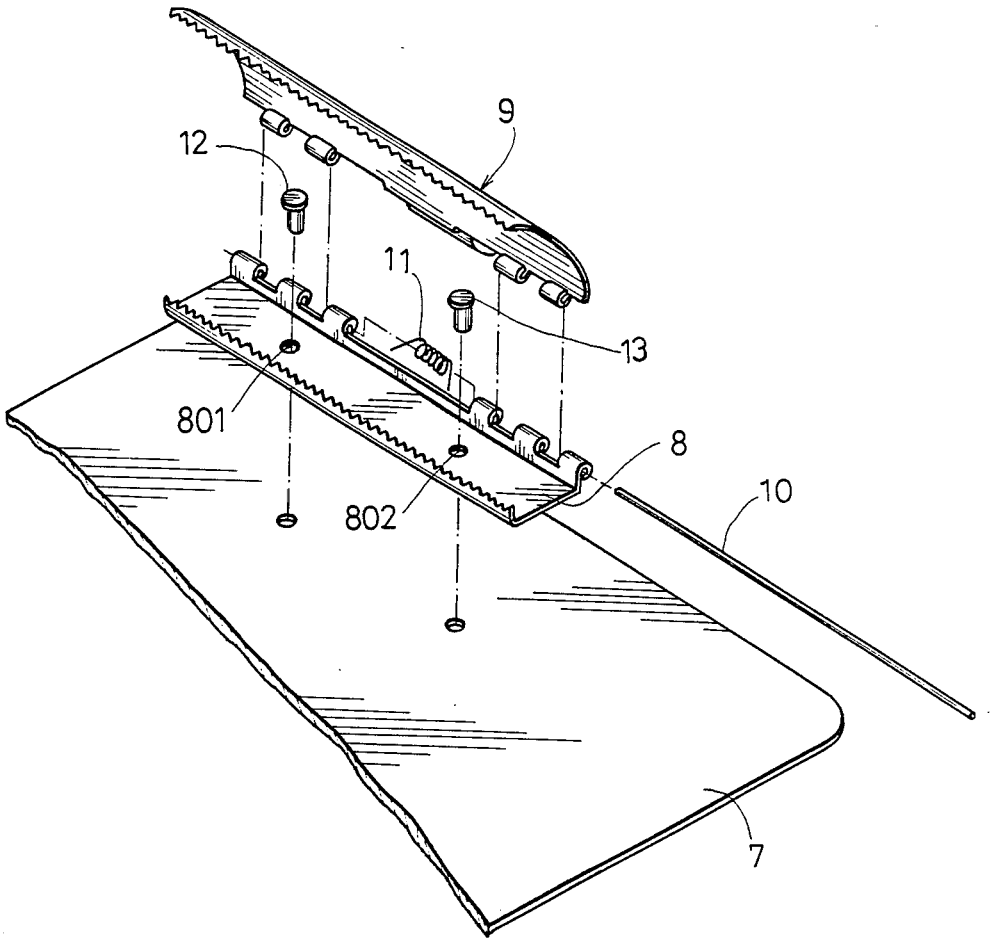
Fig. 4 PRIOR ART
FIG. 4 illustrates the exploded perspective view of another conventional clipboard.
Figure 6:
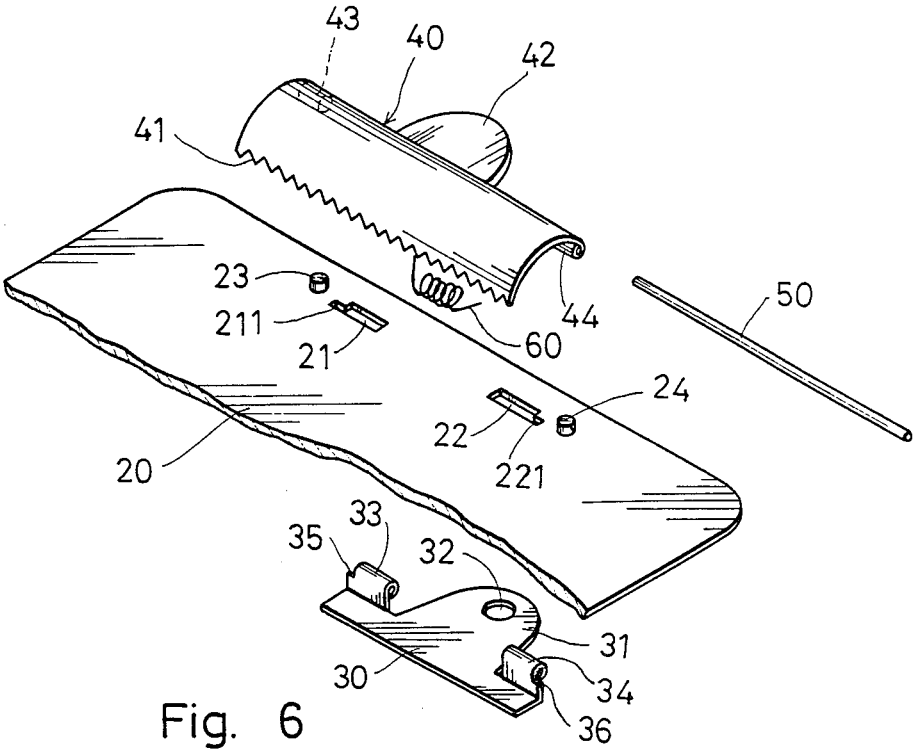
FIG. 6 illustrates the exploded perspective view of a clipboard as one of the preferred embodiments of the presenting invention.
Figure 7:
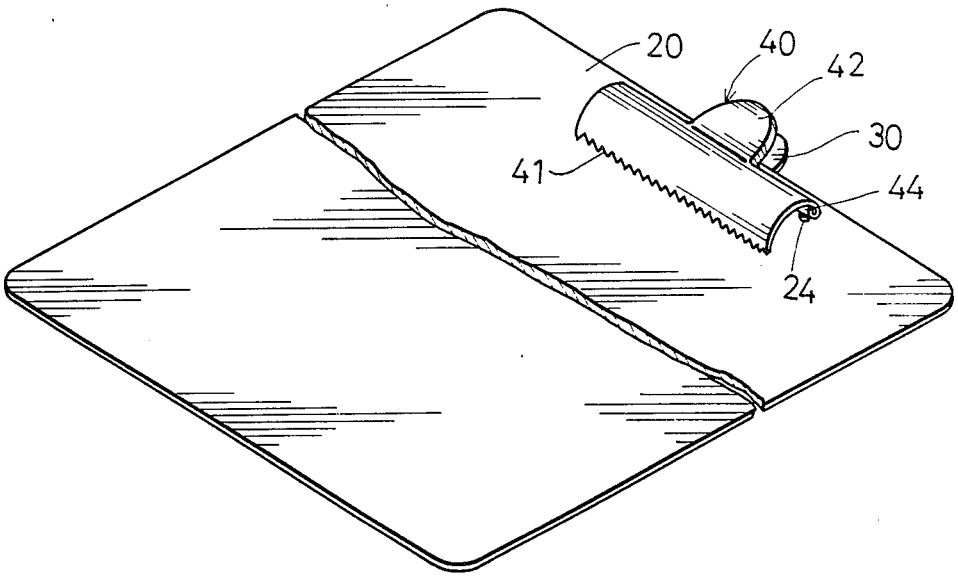
FIG. 7 illustrates the perspective view of an assemblyed clipboard.
Figure 8:
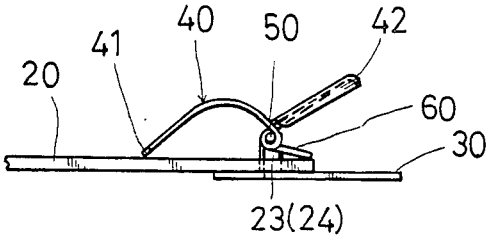
FIG. 8 illustrates the partially elevational view of the clipboard shown in FIG. 7.
Figure 9:
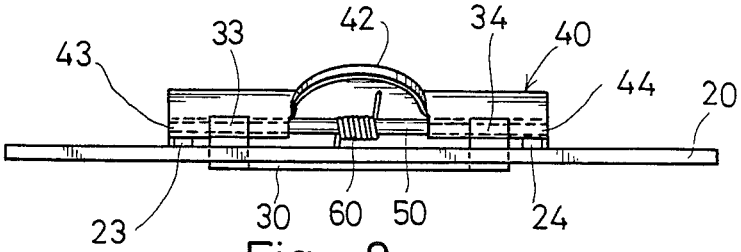
FIG. 9 illustrates the rear elevational view of the clipboard shown in FIG. 7.
Figure 10:
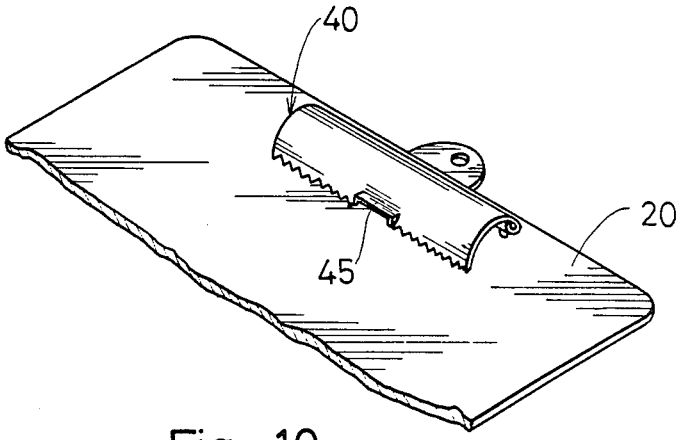
FIG. 10 illustrates the perspective view of the clipboard as one of another preferred embodiments of the present invention.

Please refer to enclosed figures. The renovated structure of clipboard in the invention mainly comprises the elements of a board (20), a supporting base (30), a clamping element (40), a pivotal axle (50) and a torsional spring (60) in which the board (20) is formed integrally. On one end of the board, there are two transverse rectangular groove holes (12) (13) of which extension of outer edges is the portion of smaller grooves (211) (221) and the outer sides are provided with convex posts (23) (24). The supporting base (30) is formed by punching and bending of metal plate. The rear extension of the supporting base is provided with an approximately sami-circular board portion (31) on which round hole (32) is provided. Both sides of the supporting base is bent upward and rolled up into tube-shaped element (33) (34) of which the outer side edge is provided with fin-shaped shoulders (35) (36). The two tube-shaped element can just penetrate through the rectangular groove holes (21) (22) of the board to make fin-shaped shoulders (35) (36) insert into grooves (211) (221) for prevention of supporting base (30) from swinging so that integral supporting base (30) can firmly and closely attach to the bottom face of the board. Being penetraled through rectangular groove holes (21) (22), the tube-shaped element may protrude board surface for a scheduled height. The clamping element (40) is also made of metal plate and integrally bent concaving downward into an appropriate arc. The front end of the clamping element is provided with teeth-shaped portion (41) and the extension of rear central portion provided with pressing portion (42) while its both sides are rolled up into tube-shaped elements (43) (44). By virtue of penetration of pivotal axle (50) through the tube-shaped elements (33) (34) of supporting base (30) and the tube-shaped elements (43) (44) of clamping element (40), the clamping element (40) and the supporting base (30) are connectedly fixed on the upper and lower surfaces of board (20). The spring (60) is enclosed over the pivotal axle (50) with its one end pushing against clamping element (40) and another end pushing against the board (30) so as to keep a clamping force between the teeth-shaped portion (41) of the front end of clamping element (40) and the board (20). Furthermore, the spring pushes upwardly against the clamping element (40) for correlated motion so as to make the supporting base (30) tightly attach to the bottom face of the board (20). Besides, the height of the convex posts (43) (44) of the assembled clamping element (40) can just be placed on it. When the press portion (42) of the clamping element (40) rear end is pressed downward for utilization of the clipboard, the clamping element (40) can use the convex posts (23) (24) as fulcrum to make the teeth-shaped portion (4) at front end open up. Please refer to FIG. 10 which shows another preferred embodiment of the clamping element (40) in the invention. The utmost difference is that it is not provided with press portion but a swelling portion (45) is provided instead. For utilization, finger will be used to lift the swelling portion (45) instead of pressing.

In conclusion of above description, the invention is so skillfully designed that the clamping element (40), supporting base (30) and the board can be assembled and coupled in a simplified way. As the pivotal axle is inserted into the tube-shaped element of the supporting base and the clamping element, the contact surface is rather large and with the assistance of spring force, the pivotal axle is prevented from swingin. Therefore the integral combination is more steady than that of original project—it is really a practical improvement.

I claim:

1. A kind of renovated structure of clipboard comprising:

a board of which one end is provided with two transverse groove slots, of which extension of outer an edge of said board is provided with smaller grooves and outer sides provided with a convex post respectively;

a supporting base of which both sides are bent upward and a rear end of said base is rolled up into tube-shaped element of which fin-shaped shoulder is provided at outer side edges; the tube-shaped element penetrates through the two transverse groove slots to make a fin-shaped shoulder insert into the smaller grooves at the outer edges of said groove slots so that the supporting base can firmly attach and adhere to the bottom face of the board and the tube-shaped element protrude through the board surface to preset height;

a clamping element on an integral element is concavely bent into an appropriate arc of which a extension of a rear central portion is provided with a pressing part and both sides are rolled up into a tube-shaped element similar to that of the supporting base while the front end contacts with said board;

a spring and a pivotal axle;

whereby the penetration of said pivotal axle through the tube-shaped element of the clamping element and supporting base and the spring, the clipboard is quickly combined and assembled without usage of rivets.

* * * * *